United States Patent [19]

Nakanishi

[11] Patent Number: 4,510,062

[45] Date of Patent: Apr. 9, 1985

[54] REFRIGERATION OIL COMPOSITION

[75] Inventor: Masayuki Nakanishi, Ichihara, Japan

[73] Assignee: Idemitsu Kosan Co., Ltd., Tokyo, Japan

[21] Appl. No.: 605,570

[22] Filed: Apr. 30, 1984

[30] Foreign Application Priority Data

May 12, 1983 [JP] Japan ..... 58-81722

[51] Int. Cl.[3] ..... C10M 3/32; C10M 1/38

[52] U.S. Cl. ..... 252/45; 252/9

[58] Field of Search ..... 252/45

[56] References Cited

U.S. PATENT DOCUMENTS 2,738,330 12/1951 Hill ..... 252/45

OTHER PUBLICATIONS

Brewer, Allen F. Basic Lubrication Practice 1955 p. 243.

*Primary Examiner*—William R. Dixon, Jr.
*Assistant Examiner*—C. Johnson
*Attorney, Agent, or Firm*—Frishauf, Holtz, Goodman & Woodward

[57] ABSTRACT

A refrigeration oil composition comprising at least one oil selected from the group consisting of mineral oils and synthetic oils, said oil having a viscosity of from 1 to 500 cSt at 40° C.; and a mercaptan of the formula RSH, wherein R is an alkyl group having 14 to 20 carbon atoms, said mercaptan being in an amount of from 5 to 5000 ppm, based on said oil composition, said refrigeration oil has excellent lubrication characteristics and is therefore effective to prevent seizure of sliding portions of the refrigerator mechanism and at the same time inhibits the occurrence of valve coking. It is also stable even in a refrigerant such as Freon and is therefore free from causing corrosion of the sliding portions of the refrigerator.

17 Claims, 1 Drawing Figure

REFRIGERATION OIL COMPOSITION

BACKGROUND OF THE INVENTION

This invention relates to a refrigeration oil composition and more specifically, to a refrigeration oil composition which is effective for the prevention of seizure, for example, of sliding parts or portions and also for the inhibition of valve coking phenomenon in a refrigerator operating in the atmosphere of a refrigerant (Freon) and is free from corroding such portions.

A refrigeration oil is a lubrication oil which is employed to maintain the lubricity of sliding portions of a refrigerator and hence to avoid wearing and/or seizure of the sliding portions. Such a refrigeration oil is obviously required to have a high degree of lubrication characteristic. Besides, it is also required to remain stable both thermally and chemically even in a refrigerant (Freon) and thus not to give any corrosive action to sliding portions (metals), and further not to produce any sludge on valve portions.

As a refrigeration oil capable of satisfying such requirements, Japanese Patent Provisional Publication No. 8294/1982 discloses a refrigeration oil composition formulated with mineral oil by adding thereto a variety of sulfur compounds to an overall sulfur content of 0.14 wt.%. The above-proposed refrigeration oil composition has improved lubricating capacity and lower viscosity, but it is still unknown as to its stability in a refrigerant such as Freon.

SUMMARY OF THE INVENTION

With the above prior art in view, the present inventor has carried out an extensive research with respect to the effects of various sulfur compounds when they are incorporated. As a result, it has been found that a composition, which has been formulated by adding a prescribed amount of a mercaptan having a specific carbon number to a base oil, shows excellent lubrication characteristic and at the same time, remains stable even in a refrigerant such as Freon and gives no corrosive action to sliding portions of a refrigerator, and inhibits the valve coking phenomenon thus leading to the development of the refrigeration oil composition of this invention.

An object of this invention is to provide a refrigeration oil of a novel composition, which is excellent in lubrication characteristic and is thus effective for the prevention of seizure of sliding portions of a refrigerator and at the same time for inhibition of occurrence of valve coking as well as is stable even in a refrigerant such as Freon and is hence free from giving any corrosive action to the sliding portions.

In one aspect of this invention, there is thus provided a refrigeration oil composition which comprises: a mineral and/or synthetic oil, preferably having a viscosity of 1–500 cSt (centistoke) at 40° C.; and, added thereto, a mercaptan represented by the formula: RSH (wherein R represents a straight-chain or branched alkyl group having 14–20 carbon atoms) in an amount of 5–5000 ppm as calculated in terms of sulfur.

The base oil, which is useful in the formulation of the composition of this invention, may be either a mineral or synthetic oil or a mixed oil in which a mineral and synthetic oils are mixed at an optional ratio. Preferably, such oils are each employed after adjusting its viscosity to 1–500 cSt, more preferably to 2–100 cSt as measured at 40° C. As exemplary mineral oils, may be mentioned naphthenic mineral oil, medium mineral oil, paraffinic mineral oil and aromatic fractions obtained by cracking such mineral oils. On the other hand, illustrative of synthetic oils may include straight-chain alkylbenzenes; branched alkylbenzenes; polyolefinic oils such as polyethylene, polypropylene and polybutene; alkylnapthalenes; ester oils; and polyglycol oils. When using such mineral and/or synthetic oils as base oils, it is preferred to subject them to clay refining prior to their formulation into refrigeration oil compositions.

In the present invention, the above-described base oil is incorporated with a mercaptan which will next be described.

In the formula: RSH, R represents an alkyl group having 14–20 carbon atoms. Any carbon number smaller than 14 will lead to lowered stability of the resulting refrigeration oil compositions in a refrigerant such as Freon, thereby giving increased corrosive action to sliding portions of a refrigerator.

On the other hand, when the carbon number exceeds 20, the solubility of the mercaptan in the base oil will be reduced. Therefore, use of a mercaptan having such a high carbon number is inconvenient.

As illustrative mercaptans useful in the practice of this invention, may be mentioned n-tetradecyl mercaptan, tert-tetradecyl mercaptan, n-pentadecyl mercaptan, tert-pentadecyl mercaptan, n-hexadecyl mercaptan, tert-hexadecyl mercaptan, n-heptadecyl mercaptan, tert-heptadecyl mercaptan, n-octadecyl mercaptan, tert-octadecyl mercaptan, n-nonadecyl mercaptan, tert-nonadecyl mercaptan, n-eicosyl mercaptan, tert-eicosyl mercaptan and the like as well as various other mercaptans containing branched alkyl groups. Among these mercaptans, mercaptans containing straight-chain alkyl groups of 14–18 carbon atoms are preferred.

Such a mercaptan may be added to the base oil in an amount of 5–5000 ppm (and preferably 20–1000 ppm) as calculated in terms of sulfur based on the refrigeration oil composition to be formulated. If it is added in any amounts lower than 5 ppm, the resulting composition will show poor lubrication characteristic and will thus be unable to avoid seizure and/or wearing of sliding portions of a refrigerator. If it exceeds 5000 ppm on the other hand, the resulting composition will exhibit reduced stability in a refrigerant such as Freon and will thus fail to avoid corrosive action to such sliding portions.

The refrigeration oil composition of this invention may be readily formulated by dissolving the mercaptan in the aforementioned base oil. Here, it may also be possible to add at least one of a phenol or phosphoric ester type antioxidant; a silicone or ester type antifoamer; a corrosion inhibitor of the glycidyl ether, polyglycol or organotin compound type; etc. suitably in the manner known per se in the art as need.

Figure 1:
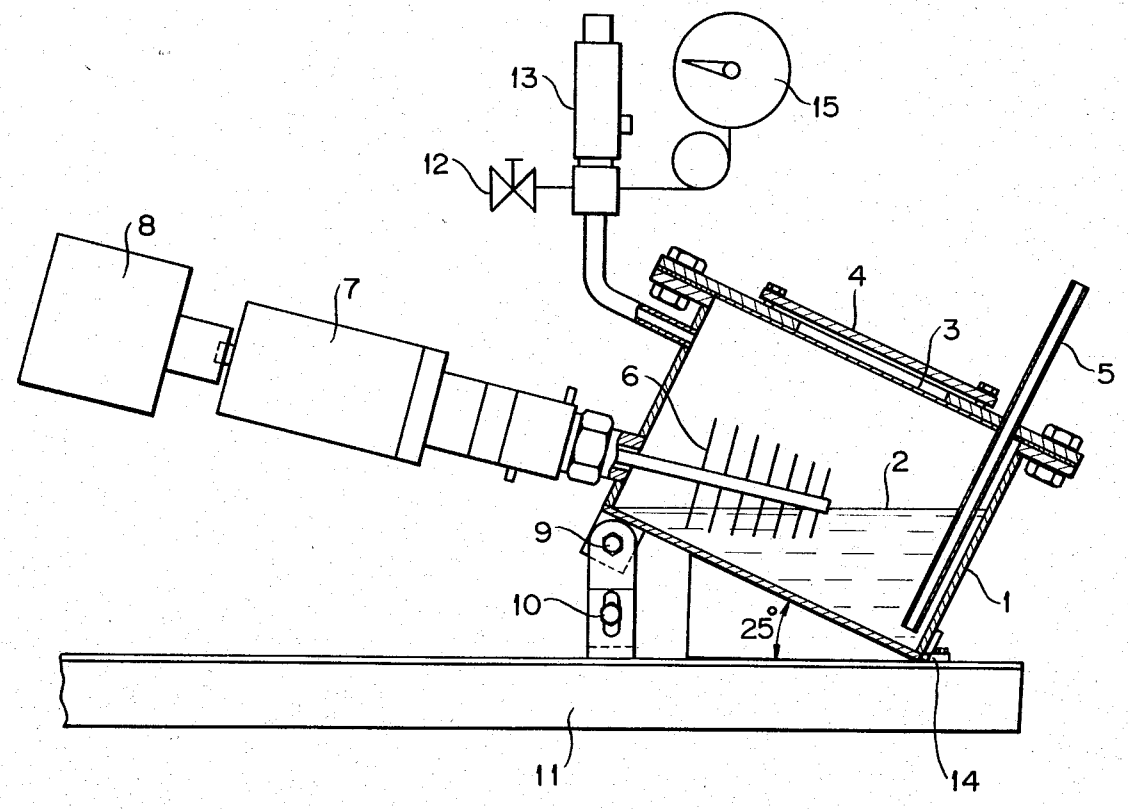
FIG. 1 is a cross-sectional elevation of the test apparatus used in the Test example as described hereinafter, in which reference numeral 1 is oil bath; 2 the level of sample oil; 3 test piece (steel plate); 4 pressing plate; 5 tube for blowing; 6 stirring fan; 7 magnetic stirrer; 8 motor; 9 supporting point; 10 fixing bolt; 11 base plate; 12 valve; 13 safety valve; 14 hinge plate; and 15 pressure gauge.

The present invention will hereinafter be described in further detail by the following Examples:

EXAMPLES (1) Preparation of base oil

A mineral oil containing 10 ppm or less of sulfur and having a viscosity of 4.9 cSt at 40° C. was brought into contact with 5 wt.% of clay to subject the former to an adsorption treatment, thereby obtaining a base oil which will be referred to as Base Oil A. The sulfur content of Base Oil A was of a trace level.

Besides, another mineral oil having a sulfur content of 4000 ppm and a viscosity of 9.6 cSt at 40° C. and a further mineral oil having a sulfur content of 10 ppm or less and a viscosity of 2.0 cSt at 40° C. were respectively brought into contact with 5 wt.% of clay so as to subject them to adsorption treatments respectively. The sulfur content of the former base oil was reduced to 2800 ppm, while that of the latter base oil was lowered to a trace level. Then, both of the thus-treated base oils were mixed at a weight ratio of 3:1. The kinematic viscosity of the base oil mixture was then adjusted to 5.4 cSt as measured at 40° C., thereby providing Base Oil B. The sulfur content of Base Oil B was 2100 ppm.

A still further mineral oil having a sulfur content of 4000 ppm and a viscosity of 9.6 cSt at 40° C. and an additional mineral oil hving a sulfur content of 10 ppm or less and a viscosity of 2.0 cSt at 40° C. were respectively brought into contact with 8 wt.% of clay so that they were subjected to adsorption treatments. The sulfur content of the former oil was 2300 ppm, while that of the latter oil was of a trace level. They were then mixed at a weight ration of 4:6, and the kinematic viscosity of the resulting oil mixture was adjusted to 2.9 cSt as measured at 40° C. to provide Base Oil C. The sulfur content of Base Oil C was 920 ppm.

An alkylbenzene having a viscosity of 36.1 cSt at 40° C. (trade name: "ABH-SH"; produced by Mitsubishi Petrochemical Co., Ltd.) was used as a synthetic oil. The alkytbenzene will be referred to as Base Oil D.

(2) Formulation of Refrigeration Oil Composition

Additives which will be given in the Table were added to each of the above-described four types of base oils to provide refrigeration oils of various compositions.

(3) Tests on the lubricating capacity of the compositions and their stability in a refrigerant, Freon:

As to each of the above-described various refrigeration oils, the lubricating capacity and stability in a refrigerant, Freon, were evaluated in accordance with the following methods.

Lubricating capacity: Falex seizure load was measured in accordance with ASTMD 2670 for the evaluation of lubricating capacity Stability: Stability was evaluated in accordance with the shielded tube testing method. The following test conditions were employed.

(1) Tube: Ampule having an internal volume of 10 ml made of Pylex glass, withstandable up to a pressure of 20 Kg/cm$^2$.

(2) Sample: 4 ml, each.

(3) Refrigerant: $CF_2CL_2$ (trade name: "Daiflon-12"; Produced by Daikin Industries, Ltd.). Used in an amount of 2 g.

(4) Catalyst: Specimens made respectively of Cu, Fe and Al (diameter: 1.6 mm; length: 40 mm).

(5) Temperature and time: 500 hours at 170° C.

(6) After completion of each test, the ampule was cooled well with liquid nitrogen and was opened at one end thereof. The open end was placed in about 100 ml of distilled water so that the resulting hydrogen chloride was absorbed in the distilled water. Then, the thus-obtained water was titrated with a 0.1-N aqueous solution of potassium hydroxide to calculate the amount of produced hydrochloric acid. At the same time, changes in external appearance of the catalysts, copper, iron and aluminium specimens, were observed. Test results are summarized in the following Table 1 and Table 1'.

TABLE 1

| | Refrigeration oil composition | | |
|---|---|---|---|
| | Type of base oil | Additive | Amount of sulfur added (ppm) |
| Ex. 1 | A | tert-tetradecyl mercaptan | 500 |
| Ex. 2 | A | n-hexadecyl mercaptan | 500 |
| Ex. 3 | A | n-hexadecyl mercaptan | 1000 |
| Ex. 4 | A | n-octadecyl mercaptan | 100 |
| Ex. 5 | A | n-octadecyl mercaptan | 1000 |
| Ex. 6 | A | n-octadecyl mercaptan | 5000 |
| Comp. Ex. 1 | A | not added | — |
| Comp. Ex. 2 | A | di-tert-heptyldisulfide | 500 |
| Comp. Ex. 3 | A | di-n-butyldisulfide | 500 |
| Comp. Ex. 4 | A | dibenzyldisulfide | 500 |
| Comp. Ex. 5 | A | thiophene | 500 |
| Comp. Ex. 6 | A | n-decyl mercaptan | 100 |
| Comp. Ex. 7 | A | n-dodecyl mercaptan | 1000 |
| Comp. Ex. 8 | A | thiophenol | 1000 |
| Comp. Ex. 9 | A | thiophenol | 5000 |
| Ex. 7 | B | n-octadecyl mercaptan | 5 |
| Ex. 8 | B | n-octadecyl mercaptan | 20 |
| Comp. Ex. 10 | B | not added | — |
| Ex. 9 | C | n-octadecyl mercaptan | 200 |
| Ex. 10 | C | n-octadecyl mercaptan | 500 |
| Comp. Ex. 11 | C | not added | — |
| Ex. 11 | D | n-octadecyl mercaptan | 500 |
| Ex. 12 | D | n-octadecyl mercaptan | 1000 |
| Ex. 13 | D | n-octadecyl mercaptan | 5000 |
| Comp. Ex. 12 | D | not added | — |

TABLE 1'

| | Test results | | | | |
|---|---|---|---|---|---|
| | | Shielded tube test | | | |
| | Falex seizure load (lbs) | Amount of hydrochloric acid produced (mg HCl/4 ml) | Changes in appearance of copper surface | Changes appearance of iron surface | Changes in appearance of aluminium surface |
| Ex. 1 | 410 | 0.5 or less | no changes observed | no changes observed | no changes observed |
| Ex. 2 | 400 | 0.5 or less | no changes observed | no changes observed | no changes observed |
| Ex. 3 | 430 | 0.5 or less | no changes observed | no changes observed | no changes observed |
| Ex. 4 | 380 | 0.5 or less | no changes observed | no changes observed | no changes observed |
| Ex. 5 | 460 | 0.5 or less | no changes observed | no changes observed | no changes observed |
| Ex. 6 | 500 | 0.5 or less | no changes observed | no changes observed | no changes observed |
| Comp. Ex. 1 | 250 or less | 0.5 or less | no changes observed | no changes observed | no changes observed |
| Comp. Ex. 2 | 400 | 0.7 | black films peeled off | no changes observed | no changes observed |
| Comp. Ex. 3 | 400 | 0.5 or less | black | grayish black | grayish black |
| Comp. Ex. 4 | 460 | 1.2 | black | black | no changes observed |
| Comp. Ex. 5 | 250 or less | 0.5 or less | red | no change observed | no changes observed |
| Comp. Ex. 6 | 390 | 0.5 or less | black | no change observed | no changes observed |

TABLE 1'-continued

| | Test results | | | | |
|---|---|---|---|---|---|
| | | Shielded tube test | | | |
| | Falex seizure load (lbs) | Amount of hydrochloric acid produced (mg HCl/4 ml) | Changes in appearance of copper surface | Changes appearance of iron surface | Changes in appearance of aluminium surface |
| Comp. Ex. 7 | 440 | 0.5 or less | black | no changes observed | no changes observed |
| Comp. Ex. 8 | 380 | 0.5 or less | black | no changes observed | no changes observed |
| Comp. Ex. 9 | 420 | 0.5 or less | black | no changes observed | no changes observed |
| Ex. 7 | 300 | 0.5 or less | no changes observed | no changes observed | no changes observed |
| Ex. 8 | 400 | 0.5 or less | no changes observed | no changes observed | no changes observed |
| Comp. Ex. 10 | 250 or less | 0.5 or less | no changes observed | no changes observed | no changes observed |
| Ex. 9 | 400 | 0.5 or less | no changes observed | no changes observed | no changes observed |
| Ex. 10 | 480 | 0.5 or less | no changes observed | no changes observed | no changes observed |
| Comp. Ex. 11 | 250 or less | 0.5 or less | no changes observed | no changes observed | no changes observed |
| Ex. 11 | 410 | 0.5 or less | no changes observed | no changes observed | no changes observed |
| Ex. 12 | 480 | 0.5 or less | no changes observed | no changes observed | no changes observed |
| Ex. 13 | 530 | 0.5 or less | no changes observed | no changes observed | no changes observed |
| Comp. Ex. 12 | 50 or less | 0.5 or less | no changes observed | no changes observed | no changes observed |

As apparent from the above results, refrigeration oil compositions according to this invention have great Falex seizure loads and produce little hydrochloric acid according to the shielded tube test. Therefore, they have good lubricating capacity and excellent stability in refrigerants such as Freon, and they thus have great industrial value.

TEST EXAMPLE

Test of coking property

According to the test method of coking property of oil as prescribed in Federal Test Method Standard No. 791B. 3462, a coking test for the refrigeration oil composition of the present invention was carried out in an atmosphere of Freon. In the apparatus for test, as shown in FIG. 1, equipped was a tube for blowing a Freon gas($CF_2Cl_2$) and Freon was blown thereinto in a state of gas. At the upper portion of the oil bath (146×100×6 (cm)), a pressure adjusting valve and a safety valve were provided.

In the attached drawing (FIG. 1), the heater for heating the test panel and the sample oils has been omitted.

Test conditions were as follows:

Rate of the Freon ($CF_2Cl_2$) blown-in: 20 l gas/hr. at 15° C.

Material of panel: cold rolling steel-plate prescribed by JIS G 3141 (88×37×0.8 mm, having dull luster finished surface)

Temperature of panel: 250° C.

Temperature of sample oil: 80° C.

Cycle of splash/stop: 15/16 seconds

Test time: 60 minutes.

According to the above conditions, panel coking test was conducted. Results are shown in Table 2. The state of the coking on the panels was evaluated by visual observation and classified into the following five ranks.

| | | |
|---|---|---|
| A: | percentage of area having coking deposit | 10% or less |
| B: | percentage of area having coking deposit | 10 to 25% |
| C: | percentage of area having coking deposit | 25 to 50% |
| D: | percentage of area having coking deposit | 50 to 80% |
| E: | percentage of area having coking deposit | 80% or more (almost all surface) |

TABLE 2

| | Refrigerator oil composition | | | Test results |
|---|---|---|---|---|
| | Type of base oil | Additive | Amount of sulfur added (ppm) | Coking trend |
| Example 14 | A | tert-tetradecyl mercaptan | 100 | A |
| Example 15 | " | n-hexadecyl mercaptan | 100 | A |
| Example 16 | " | n-octadecyl mercaptan | 100 | A |
| Example 17 | " | n-octadecyl mercaptan | 500 | A |
| Comp. example 13 | " | thiophene | 100 | D |
| Comp. example 14 | " | dibenzyl disulfide | 100 | C |
| Comp. example 15 | " | — | — | E |

As apparent from Table 2, the refrigeration oil composition according to the present invention are extermely useful since they have remarkable effects on preventing the occurrence of coking.

I claim:

1. A refrigeration oil composition comprising:

at least one oil selected from the group consisting of mineral oils and synthetic oils, said oil having a viscosity of from 1 to 500 cSt at 40° C.; and a mercaptan of the formula RSH, wherein R is an alkyl group having 14 to 20 carbon atoms, said mercaptan being in an amount of from 5 to 5000 ppm, based on said oil composition, as calculated in terms of sulfur.

2. The refrigeration oil composition according to claim 1, wherein said alkyl group R is an alkyl group having 14 to 18 carbon atoms.

3. The refrigeration oil composition according to claim 1, wherein said viscosity is 2 to 100 cSt at 40° C.

4. The refrigeration oil composition according to claim 1, wherein said mercaptan is in an amount of 20 to 1000 ppm as calculated in terms of sulfur.

5. The refrigeration oil composition according to claim 1, wherein said mercaptan is at least one selected from the group consisting of tert-tetradecyl mercaptan, n-hexadecyl mercaptan and n-octadecyl mercaptan.

6. The refrigeration oil composition according to claim 1, wherein said composition further comprises at least one additive selected from the group consisting of an antioxidant, an antifoamer and a corrosion inhibitor.

7. The refrigeration oil composition according to claim 1 wherein said oil is a mineral oil selected from the group consisting of naphthenic mineral oil, medium mineral oil, paraffinic mineral oil and aromatic fractions obtained by cracking these mineral oils.

8. The refrigeration oil composition according to claim 1, wherein said oil is a synthetic oil selected from the group consisting of straight-chain alkylbenzenes, branched alkylbenzenes, polyolefinic oils, alkylnaphthalenes, ester oils and polyglycol oils.

9. The refrigeration oil composition according to claim 4, wherein said viscosity is 2 to 100 cSt at 40° C.

10. The refrigeration oil composition according to claim 9, wherein said alkyl group R is an alkyl group having 14 to 18 carbon atoms.

11. The refrigeration oil composition according to claim 9, wherein said mercaptan is at least one selected from the group consisting of tert-tetradecyl mercaptan, n-hexadecyl mercaptan and n-octadecyl mercaptan.

12. The refrigeration oil composition according to claim 10, wherein said mercaptan is at least one selected from the group consisting of tert-tetradecyl mercaptan, n-hexadecyl mercaptan and n-octadecyl mercaptan.

13. The refrigeration oil composition according to claim 10, wherein said mineral oil is selected from the group consisting of naphthenic mineral oil, medium mineral oil, paraffinic mineral oil and aromatic fractions obtained by cracking these mineral oils; and wherein said synthetic oil is selected from the group consisting of straight-chain alkylbenzenes, branched alkylbenzenes, polyolefinic oils, alkylnaphthalenes, ester oils and polyglycol oils.

14. The refrigeration oil composition according to claim 12, wherein said mineral oil is selected from the group consisting of naphthenic mineral oil, medium mineral oil, paraffinic mineral oil and aromatic fractions obtained by cracking these mineral oils; and wherein said synthetic oil is selected from the group consisting of straight-chain alkylbenzenes, branched alkylbenzenes, polyolefinic oils, alkylnaphthalenes, ester oils and polyglycol oils.

15. The refrigeration oil composition according to claim 10, wherein said composition further comprises at least one additive selected from the group consisting of an antioxidant, an antifoamer and a corrosion inhibitor.

16. The refrigeration oil composition according to claim 12, wherein said composition further comprises at least one additive selected from the group consisting of an antioxidant, an antifoamer and a corrosion inhibitor.

17. The refrigeration oil composition according to claim 14, wherein said composition further comprises at least one additive selected from the group consisting of an antioxidant, an antifoamer and a corrosion inhibitor.

* * * * *